US007416448B2

(12) United States Patent
Gaidosch

(10) Patent No.: US 7,416,448 B2
(45) Date of Patent: Aug. 26, 2008

(54) CABLE PLUG

(75) Inventor: Othmar Gaidosch, Ostfildern (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/543,142

(22) PCT Filed: Dec. 12, 2003

(86) PCT No.: PCT/EP03/14157

§ 371 (c)(1),
(2), (4) Date: Mar. 30, 2006

(87) PCT Pub. No.: WO2004/066447

PCT Pub. Date: Aug. 5, 2004

(65) Prior Publication Data

US 2006/0205251 A1 Sep. 14, 2006

(30) Foreign Application Priority Data

Jan. 23, 2003 (DE) ..... 103 02 711
May 26, 2003 (DE) ..... 103 23 614

(51) Int. Cl.
*H01R 9/03* (2006.01)

(52) U.S. Cl. ..... 439/610; 439/95

(58) Field of Classification Search ..... 439/610, 439/607, 395, 404, 407, 583, 585, 95
See application file for complete search history.

(56) References Cited

U.S. PATENT DOCUMENTS

| | | | | | |
|---|---|---|---|---|---|
| 4,857,015 | A * | 8/1989 | Michaels et al. | ..... | 439/610 |
| 4,960,388 | A * | 10/1990 | Frantz et al. | ..... | 439/404 |
| 6,034,325 | A * | 3/2000 | Nattel et al. | ..... | 174/59 |
| 6,048,227 | A * | 4/2000 | Rupp et al. | ..... | 439/610 |
| 6,162,095 | A * | 12/2000 | Holman | ..... | 439/610 |
| 6,283,793 | B1 * | 9/2001 | Nakata | ..... | 439/610 |
| 6,339,193 | B1 * | 1/2002 | Goett et al. | ..... | 174/78 |
| 6,639,146 | B1 * | 10/2003 | Chiu | ..... | 174/359 |

FOREIGN PATENT DOCUMENTS

| | | |
|---|---|---|
| EP | 0 434 256 | 7/1995 |
| EP | 1 158 611 | 11/2001 |
| WO | WO 01/13470 | 2/2001 |

* cited by examiner

*Primary Examiner*—Hien Vu
(74) *Attorney, Agent, or Firm*—Andrew Wilford

(57) ABSTRACT

A plug or socket connectable to a cable having at least one conductor and a shielding is formed of several subassemblies and has a tubular and at least partially metallic casing and an electrically insulating holder fitted in the casing. A contact in the holder has a press-fit connection secured to the conductor. A contacting element separate from the casing forms in the casing an electrical connection between the casing and the shielding.

10 Claims, 14 Drawing Sheets

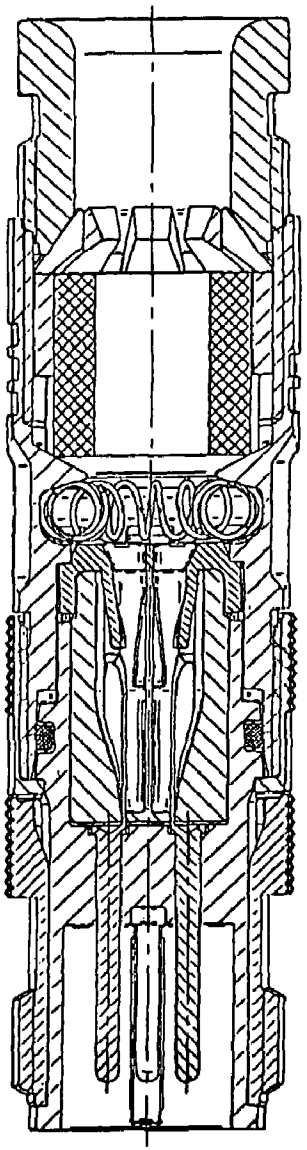
D-D
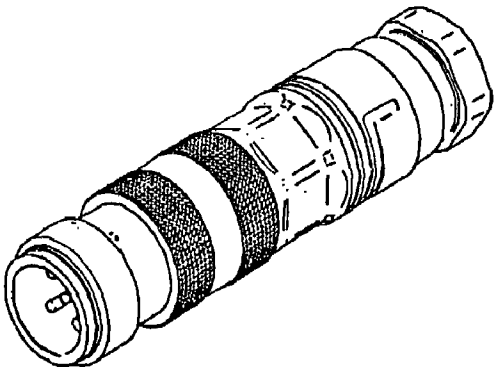
FIG. 9b
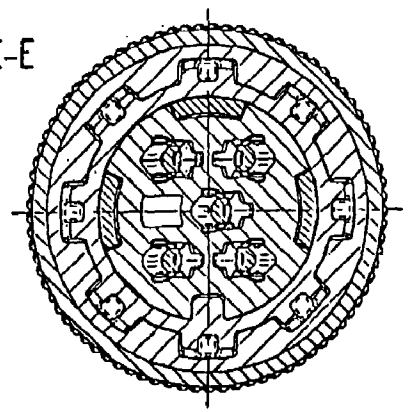
E-E

CABLE PLUG

CROSS REFERENCE TO RELATED APPLICATIONS

This application is the US national phase of PCT application PCT/EP2003/014157, filed 12 Dec. 2003, published 5 Aug. 2004 as WO 2004/066447, and claiming the priority of German patent application 10302711.4 itself filed 23 Jan. 2003 and of German application 10323614.7 filed 26 May 2003, whose entire disclosures are herewith incorporated by reference.

FIELD OF THE INVENTION

An important trend in the plug or cable connector field is to make the permanent electrical connection between insulated electrical connectors and the respective contacts of plugs, connectors, device sockets, sensor-actuator modules, printed-circuit modules, and the like as practical as possible, that is with minimal expense and time. A principal requirement is to make this connection manually without the use of tools and without error. In this regard expressions, such as for example "quick-connect contact" and "quick-connect coupling," have been coined. The main contact systems are the press-fit system, the insertion system, the gripping system, and the spring-contact system. A further very important trend that is derived from the generally known technical developments is to miniaturize plugs and cable connectors, as a rule with the same load requirements. In this regard the most important solder-free electrical connection is the press-fit system.

BACKGROUND OF THE INVENTION

Plug and socket fittings for plug connection are known that are formed by several subassemblies. These comprise at least one metallic or metallized casing that provides shielding t the cable end. In this manner the shielding of the cable is connected with the housing while the individual conductors of a normally multiconductor cable are each connected with a contact of the plug or socket by a press-fit connection. Such a known plug or socket has several disadvantages. First it is necessary to spread the shield wrap of the cable in order to fit the conductors within the shield wrap in a holder that in turn carries the press-fit connections. To connect the shielding with the housing there is a conical element over which the spread shielding is flattened and that is compressed against an abutment on assembly. As a result the assembly cost for such a plug or socket is not only high, but is error-prone since the shielding is often comprised of very thin filaments that are easily cut off by the inexperienced when the insulation jacket surrounding the shielding is removed to expose the shielding. This creates the danger that the shield braid is damaged or largely removed so that there is insufficient electrical contact with the compression cone and to the casing of the plug or socket and as a result the shielding is nonexistent or poor. An effective shield is absolutely essential in the transmission of high-frequency or high-data-rate signals. What is more, systems now require four separate lines. It has not been considered possible to convert such plugs that have a central contact, since standards require the outer contacts to be very closely spaced. The use of press-fit terminals and their insulating seats uses up the space that would be occupied by a central contact and thus limits the use of such plugs.

The known press-fit terminals or forks are flat. In order to generate the required contact forces, the contact arms just be relatively thick in the deflection direction and thus are blocky.

This disadvantage is compounded by the fact that the press-fit terminals normally lie in planes that are perpendicular to the planes in which the wires extend to them or are deflected through them (EP 1,158,611). A further disadvantage of flat press-fit terminals is that they must be fitted in respective grooves formed in a block of insulating material that is also formed with guides for feeding in the wires. These seats fix the press-fit terminals in position and ensure that the arm edges cut through the wire insulation and are not deflected by it when the wires are jammed in place. As a result of the limited engagement face that these press-fit terminals have exposed in the deflection direction, considerable lateral pressure is exerted on the sides of the plastic seats and they can be damaged by it. This effect is particularly true for stamped press-fit terminals which have raw sharp-cornered edges.

OBJECT OF THE INVENTION

It is an object of the invention to provide a shielded socket or plug having press-fit terminals where the electrical connection between the shielding of the cable and at least one part of the casing of the plug or socket is of relatively simple construction, forms a solid connection, and is not expensive to put together.

SUMMARY OF THE INVENTION

This object is attained according to the invention in that there is a separate contact element that forms the electrical connection between the casing and the shielding when the subassemblies of the plug or socket are put together. Such a separate contact element is part of one of the subassemblies and can either be fitted over the shield braid of the cable after the shield braid has been exposed. The thus trimmed end of the cable is then put together with the remaining subassemblies in order to hook up the plug or socket and complete it. This is done in one step without having to deal further with the shield braid (for example it is not necessary to spread it as in the prior art) in order to make the shielding continuous. Or the contact element is put into one of the subassemblies of the plug or socket and then the cable with the exposed shield is set in place. In a particularly advantageous embodiment of the invention the contact element is formed as an iris spring whose shape allows it to bear radially inward on the exposed shield braid and radially outward on the casing to form a good electrical connection between the shield braid and the casing. An iris spring has the further advantage that it is at least limitedly elastically compressible so as to be able to compensate out tolerance problems and bring to bear the necessary spring force for a good connection over the service life of the plug or socket.

In addition to cables that have a plurality of conductors surrounded by a shield braid, there are shielded cables in which there is at least one shield or ground conductor. Such cables, that if necessary have both a shield/ground wire and a shield braid are used in networks for certain bus systems. Here also there must be a continuous shielding of the cable over the plug connection (e.g. from a plug to a socket or from a plug or a socket to a sensor, an actuator, a device or the like) at high data rates or high frequency. According to the invention this is accomplished in that the shielding includes one or more wire conductors and the electrical connection between a housing part of the plug or socket and a contact is effected through a contact element. In this manner a standard press-fit terminal is used to connect up the wire conductor for the shield and also to form a connection between this contact and the casing of the plug or sleeve for outside shielding.

A particular advantage of the plug or sleeve for press-fit application is when the individual contacts are symmetrically arranged, since this makes it possible to carry high data rates or high frequencies. An example for such a symmetrical is a five-pole plug where there is a central contact and a plurality of outer contacts surrounding it (four or at least four such outer contacts). To this end according to a further feature of the invention that is described in the dependent claims the contacts have particular shapes and orientations so as to make the plug (or socket) particularly compact. Only with such orientation and arrangement of the press-fit terminals of the contacts and the orientation of the terminals in the contact holder and wire holder is it possible to provide a central contact.

BRIEF DESCRIPTION OF THE DRAWING

Therein.

SPECIFIC DESCRIPTION

The embodiment relates to a five-pole standard industry (IP 67 according to IEC 60529) E-series plug of a connector according to IEC 61076-2-101 with quick-connect press-fit terminals and axial cable feed in a particularly compact construction. The plug is assembled by the user without the use of tools. It is not necessary to clamp or strip the wires before insertion into the press-fit terminals. In addition the plug can be supplied in a shielded style with electrically throughgoing metallic or metallized housing parts where the cable shield, when used as a quick connect, can be particularly simply and quickly electrically connected to the casing. The plug of such a connection is used with a socket for example to transmit ethernet signals, that is at data rates of 100 Mbps. Furthermore for example the central conductor can be connected with the metallic casing.

Figure 1A:
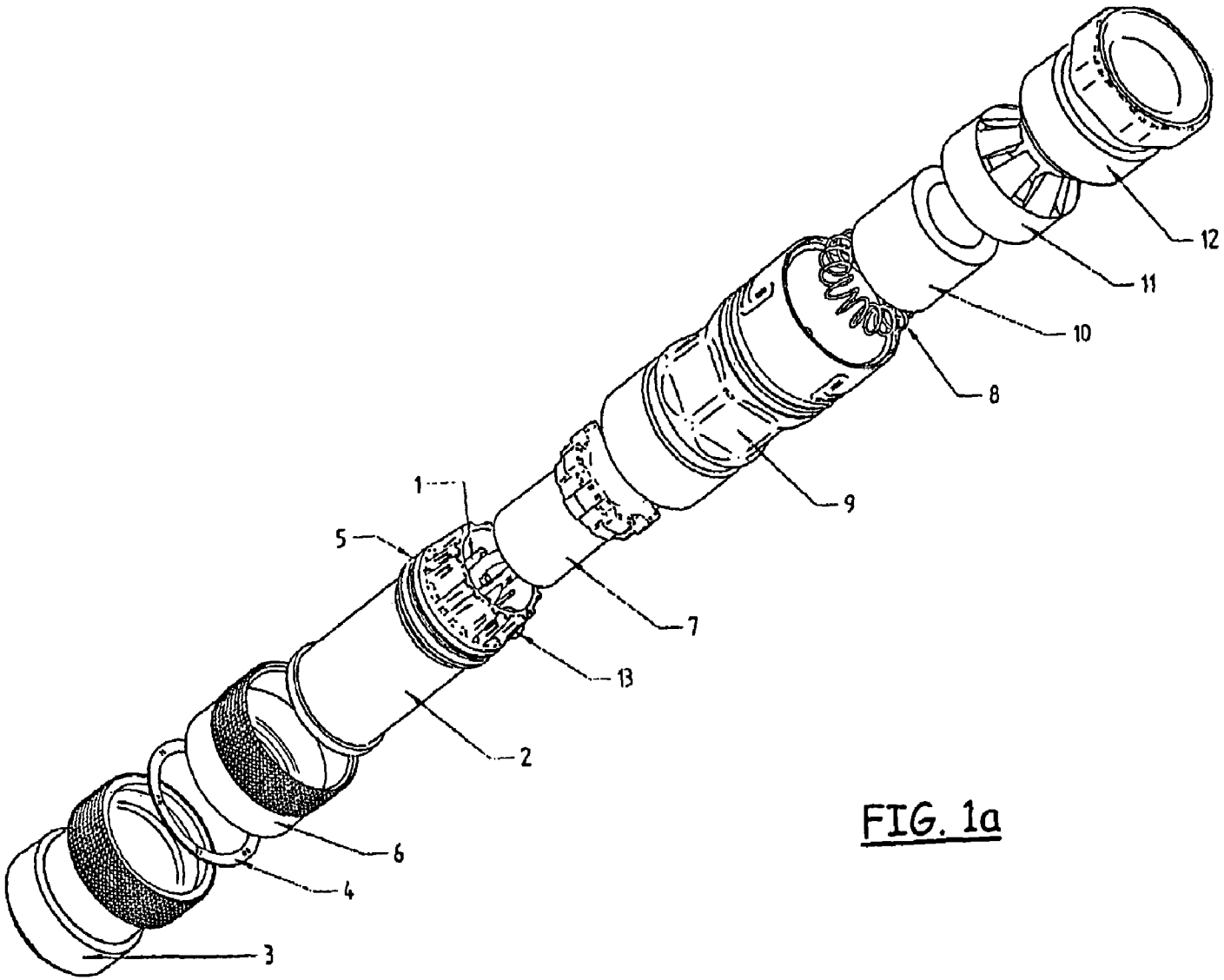
FIGS. 1*a*, 1*b*, and 1*c* are overall, sectional, and detail views of a first embodiment of a plug.

FIG. 1*a* shows the subassemblies that make up the plug partly individually and partly in exploded view:

Entire contact holder: Contacts 1 and contact holder 2 and coupling element 3 and contact element 4 and coupling element 6 and seal element 5 and contact element 13.

Wire holder 7;

Entire casing (grip sleeve): Sleeve 9 and contact element 8; alternatively the sleeve 9 and the contact element 8 can be provided as individual parts.

Entire strain-relief element: Seal element 10 (for example a hose or O-ring) and strain-relief element 11.

Actuating element 12. The actuating element 12 serves to press the strain-relief element 11 and the seal element 10 against and lift it from the surface of the cable and is shown in FIG. 1*a* as a lock nut. The cable shown in FIG. 1*b* has multiple conductors and shielding 15 (shield net) under a cable jacket 14 surrounding several D-diameter conductors 16 (for example stranded or solid), although this described cable type is not required.

The subassemblies and their element and their shapes are described in the following with if necessary reference to other figures.

Figure 2:
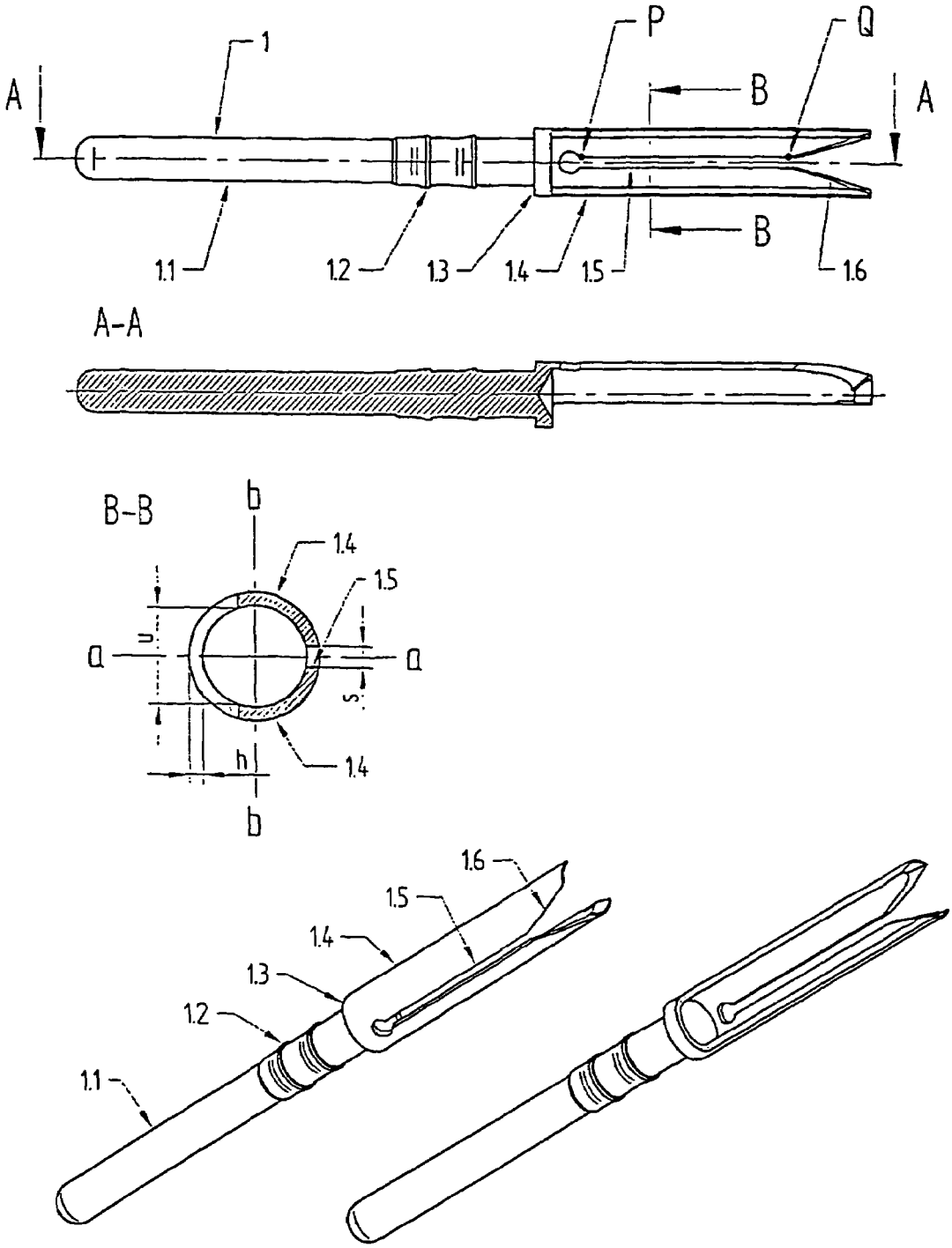
FIG. 2 is several views showing the structure of a contact.

The plug shown in FIG. 1*a* comprises:

The electrical contact 1 (see also FIG. 2) that is formed as a contact pin 1.1 extending in the connection direction of the plug but can also be formed as a contact sleeve, hybrid contact, printed-circuit contact, solder terminal, or the like. For mounting in an insulated holder, the contact 1 has projections 1.2 that if needed to prevent rotation can also have longitudinally extending parts (e.g. ridges). To aid in mounting (as abutment) and to resist the force of press-fit there is the face 1.3. The contact 1 has press-fit arms 1.4 forming a press-fit terminal and extending parallel to the conductors, the intervening slots 1.5 having a width s and entry bevels 1.6 that serve on the one hand to center the conductor and the other hand to reduce the insertion force. The press-fit arms 1.4 shown here are of ring-segmental section constructed such that the dimension u is equal to or slightly less than the diameter D of the wire to be contacted. In another extreme case this press-fit clip can be constructed such that u=s, providing double cutting-clamping action. In addition the ring-segmental shape is only one of many shapes according to which the cross-section of the press-fit arms is arcuate, here for example elliptical. It is also possible to use a polygonal section, each arm in this case being of L-section (for simple cutting/clamping action) or C- or U-shaped for double cutting/clamping action). Press-fit clips with such arcuate or polygonal arm sections have the considerable advantage that in a very compact space they have the same spring grip as much larger flat press-fit clips. It is also possible to use a combination of arcuate and polygonal sections (e.g. a slot shape) and further naturally also to make press-fit clips with straight arms extending axially of the plug. A particularly interesting aspect of all these embodiments is when the slot width s is not constant along the slot, but variable, in particular V-shaped so that the slot is slightly smaller at its base than at the entry bevels 1.6: $s_P<s_Q$. This shape is above all useful in contacts where the conductor extends at a small acute angle to the press-fit slot (as in the illustrated plug) since in this case there is a longer contact region than with transversely extending conductors. Since the relationship between the diameter of the conductor and the width of the slot of the press-fit clamp is directly related to the contact quality, such a V-slot is possible that can accept skinnier conductors at the slot base (point P) than further out so that the scope of application of such a press-fit clamp is correspondingly increased. In addition it is above all possible with stamped press-fit clips to improve the quality of the contact and/or increase the application scope relative to the conductor diameter to make the slot edges nonstraight, but for example to shape them as very flat sinusoids or flatly merging steps or the like whereby as above the slot width s is either constant or varying. In addition the orientations of the edges having the dimension h of the press-fit slot 1.5, of the entry bevels (1.6), and of the press-fit arms 1.4 relative to the axes a-a and b-b (see FIG. 2, section B-B) be the same and/or vary partly over the length of these regions or be set between these two limits. Similarly the dimension h can be the uniform and/or vary along these edges so as to optimize the press-fit action.

Figure 3:
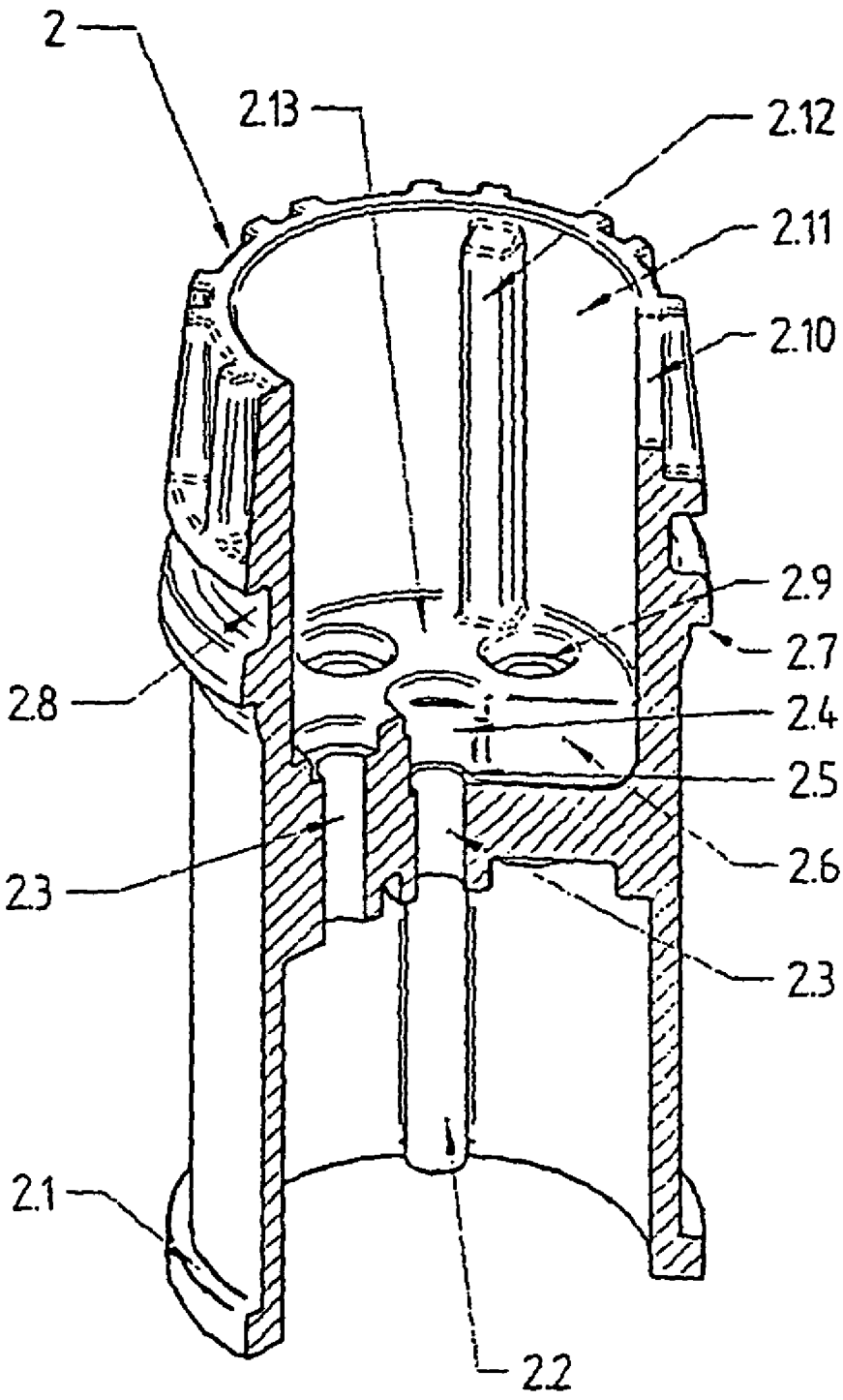
FIG. 3 is a view of a contact holder for receiving the contacts.

FIG. 3 shows a contact holder 2 formed of electrically insulating material and having a support rim 2.1 for the coupling element 3, a coding or twist preventer 2.2, and holder bores 2.3 in which the contacts 1 are press-fitted in defined positions.

Support surfaces 2.9 are provided in the bores 2.3 for the contact faces 1.3. Optionally one of the holder bores 2.3 (here the center bore), which must be in electrical contact with the metallic casing of the plug, is provided with an additional concentric seat bore 2.4 that holds or secures the contact element 13 for the shielding. The contact holder 2 is formed at this seat bore or the contact element with a support surface 2.5 as well as a holder or mounting groove 2.6 and a throughgoing slot 2.10. In addition the contact holder 2 has a further abutment rim 2.7 for the coupling element 6, and a seal groove or surface 2.8, a guide surface 2.11, and a further coding or twist preventer 2.12 as well as an abutment face 2.13.

Figure 1B:
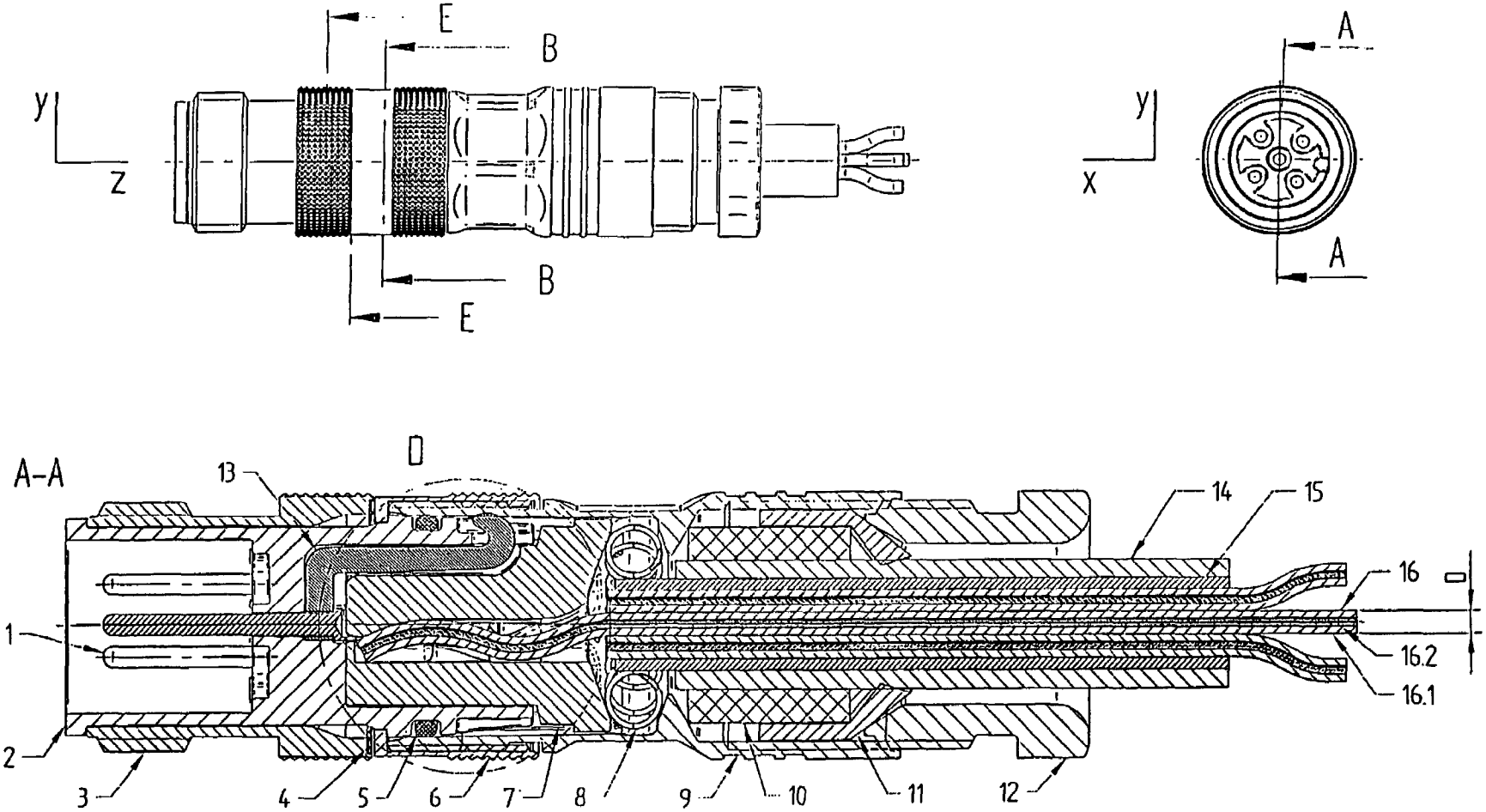
Figure 1C:
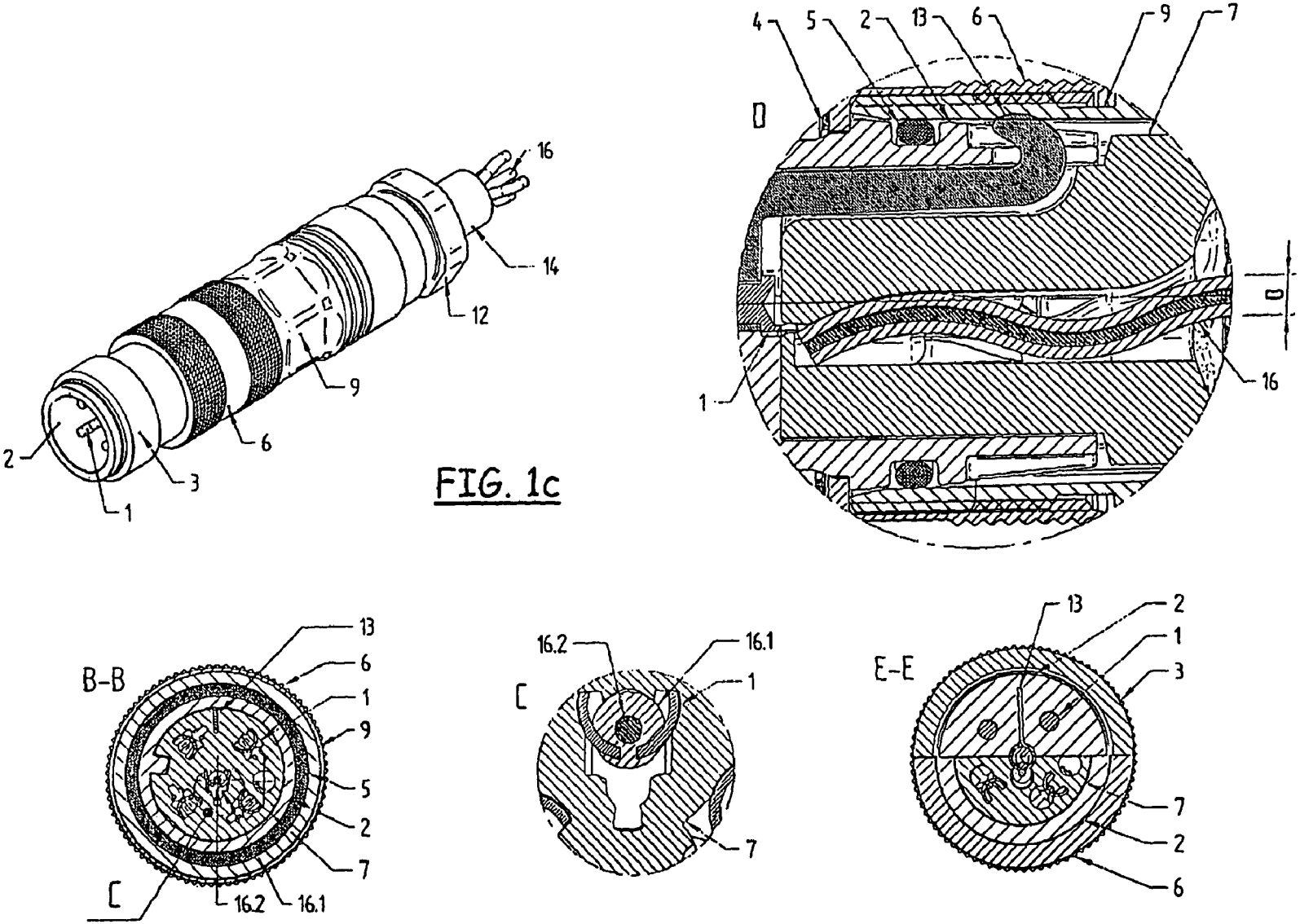

In addition the plug has a coupling element, in particularly the closed metallized or metallic coupling element 3 with a knurled surface that is shown in FIGS. 1*a*, 1*b*, and 1*c* with an outside screwthread that fits with a complementary screwthread of an unillustrated socket. Furthermore there is a contact element 4 that is formed as a spring washer (see also FIG. 5) that electrically connects the coupling elements 3 and 6. Furthermore there is a seal 5 that is shown in FIG. 1*b* as an O-ring. A further coupling element, in particular the closed metallic or metallized connector element 6 that forms a further part of the casing of the plug has a knurled surface and is shown in FIGS. 1*a*, 1*b*, and 1*c*.

Figure 4A:
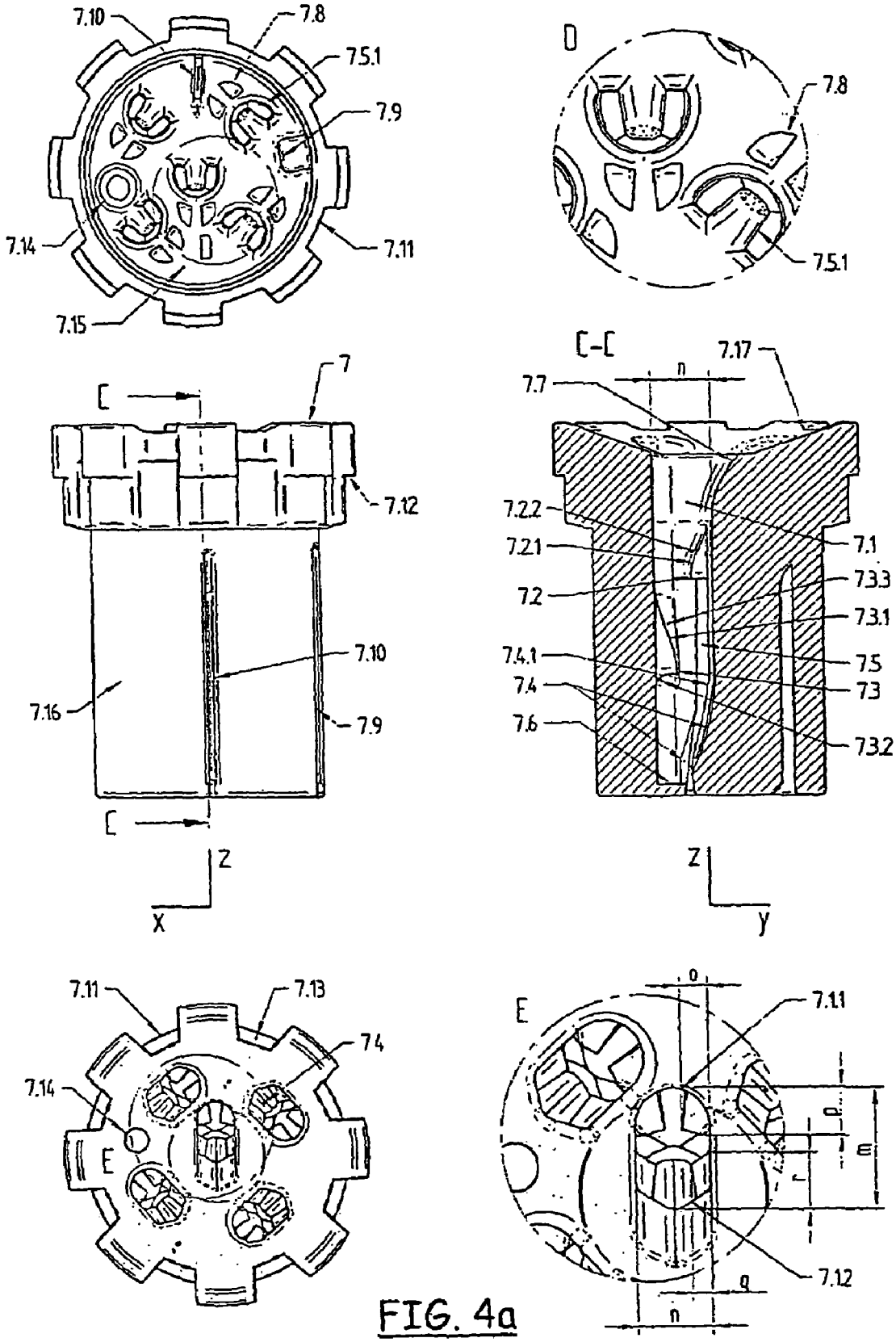
FIGS. 4*a* and 4*b* are various views of a wire holder for receiving the ends of the conductors and the press-fit terminals in the region in which the press-fit contacting takes place.
Figure 4B:
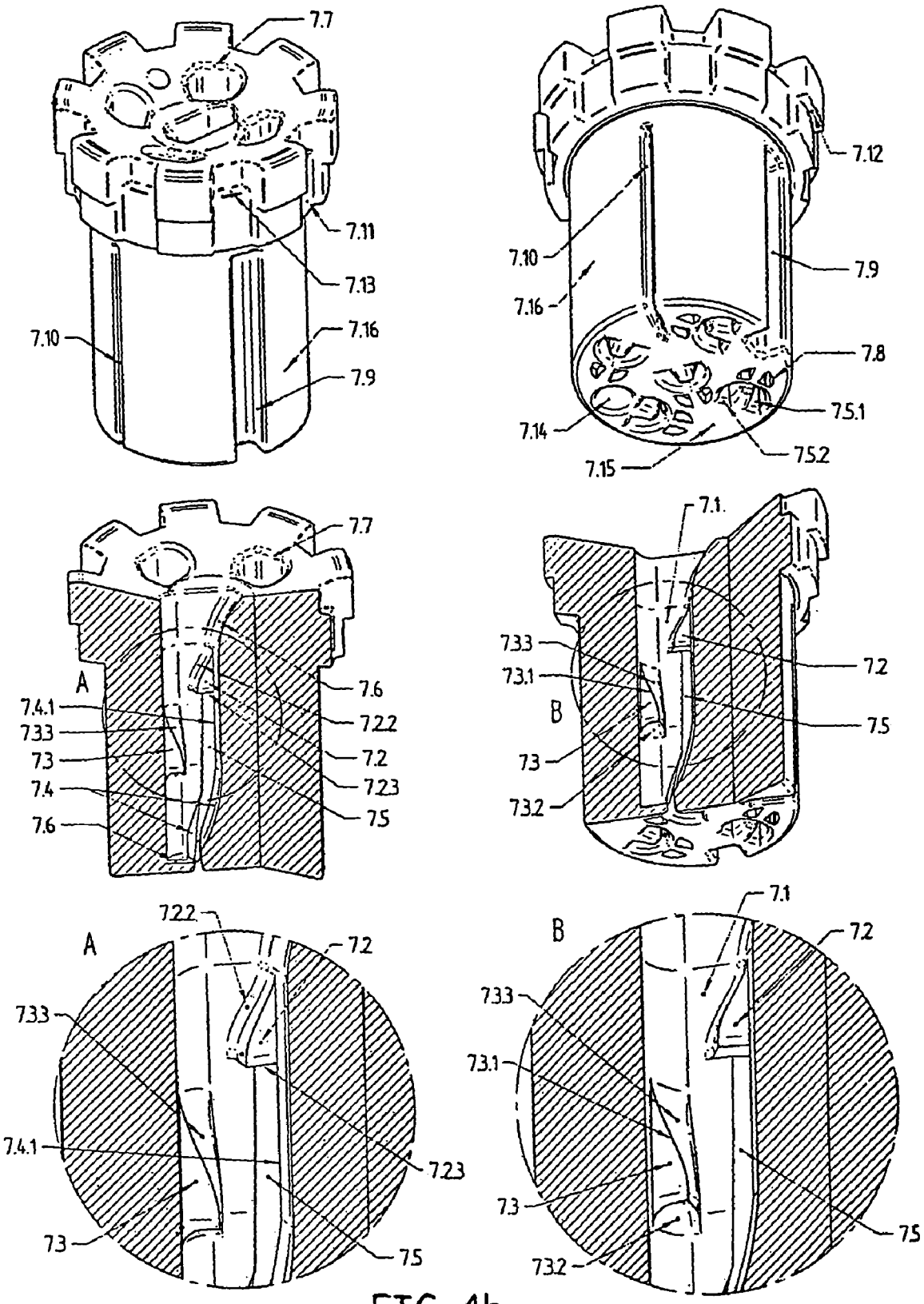

FIGS. 4*a* and 4*b* show various views and sections of a wire holder 7 of electrically insulating material and formed with wire seats 7.1 in which the respective wires are held and positioned for contacting with the respective press-fit clips. The wire seats 7.1 are formed as funnels at one end with wire-guiding entry bevels or roundings 7.7. Further in (direction −z) the shape of the seats 7.1 is at first of uniform cross-section with the area m*n (see FIG. 4*a*). Here dimension m determines the extent to which the wire is deflected while n is the diameter of the wire so that when inserted into the press-fit clip it cannot slip to the side. At their ends the wire seats each have a deflecting bevel 7.4 which reduces the cross section to that of the end of the wire and this is positioned in an x-y projection exactly relative to the press-fit clip such that the y dimension of the conductor 16.2 is for a solid electrical contact smaller than the y dimension of the slot of the press-fit clip. This positioning ensures that the clip cuts into the end of the wire and also uses space efficiently. In the opposite direction the dimension m is such that the x-y projection of the metallic conductor clearly runs across the press-fit clip. As a result of the fact that the diameter of the metallic conductor is inherently smaller than the conductor diameter D, there is certain contact satisfying the relationship m<2D. At the end of each wire seat 7.1 there is another abutment face 7.6 that ensures that a current-conducting conductor cannot poke through the wire seat 7.1. At the same time this face 7.6 forces the conductor end in the z-direction into an exact position in the press-fit clip. Whereas the cross section of the wire seat 7.1 has flat faces defining the width n, it tapers in the region with dimension m either to a somewhat curved, semicircular shape 7.1.1 or into a polygonal or V-shape 7.1.2. These ends can of course also have the same shape. This shape can be maintained over the deflecting face 7.4 to the abutment face 7.6 in the same or a similar manner. This tapering is above all significant with conductors having a smaller diameter than the seat width n, so as to center the conductors when they are deflected on a center plane of the wire seat 7.1. In addition there is inside each of the seats 7.1 one or more, in particular two deflecting ribs 7.2 and spaced along the z-axis one or more and here two deflector ribs 7.3. These deflecting ribs 7.2 and 7.3 are provided with relatively flat flanks 7.2.1 and 7.3.1 extending in the wire-feed direction so as to prevent hooking on the wires and reducing the friction during assembly. Furthermore the deflecting ribs 7.2 and 7.3 have along these angled flanks in their x- and y-dimensions further flanks 7.2.2 and 7.3.3 that work like the seat restrictions 7.1.1 and 7.1.2 for centering skinnier conductors. For this effect the flanks 7.2.2 and 7.3.3 are according to the number and distribution of the deflecting ribs 7.2 and 7.3 differently shaped along the seat dimension n so that, as shown for example with the flank 7.3.3, they have a variable angle. The deflecting ribs 7.2 or the deflecting rib 7.3 have toward the abutment 7.6 a further flank 7.3.2 that also centers the end of the conductor, above all during backward deflection during deflection into the press-fit clip. With respect to the actual shape of these flanks 7.3.2 the same is true as for the flanks 7.2.2 and 7.3.3. The abutment 7.1, the deflecting flank 7.4, and the deflecting ribs 7.2 and 7.3 are so spaced along the z-axis that it is possible to push the conductor into the wire seat 7.1 with a relatively small force. A further important part of the wire seat 7.1 is the guide surface 7.5 which serves to guide the press-fit arms 1.4 and above all to resist their elastic outward deflection when a conductor is fitted in. The deflection of the guide surface 7.5 in the z-direction is at least as long as the insertion depth of the press-fit clips and ends preferably at the lower flank of the deflecting rib 7.2. Since the deflecting rib 7.3 is located about halfway along the insertion depth, it is sure that the conductor will be engaged at least once and often at two location offset in the z-direction so as to make a very good connection. Like the guide face 7.5, the wire holder 7 has openings 7.5.1 open toward the press-fit clips so that the press-fit clips can engage into the respective wire seats 7.1. The outer shape of these openings 7.5.1 conforms either over its entire circumference or only over a part thereof (for example when the press-fit arms 1.4 are supported or guided at specific location) to the outer shape of the respective press-fit clip while the remaining region is spaced from the press-fit clip. It is important in this regard that the wire holder 7 is made by injection molding so that the x-y projection of the inner shape of the opening 7.5.1 facilitates demolding with the projection of the seat surface 7.4.1 that extends over the deflecting race 7.4 to the deflecting rib 7.2. On the other hand this inner shape corresponds with the lower edge 7.2.3 of the deflecting rib 7.2. The opening 7.5.1 is provided with the entry bevel 7.5.2 that prevents canting of the entering press-fit clip. On the side of the wire holder 7 toward the press-fit clips it has at each wire seat 7.1 further openings 7.3 whose number corresponds to the number of deflecting ribs 7.3 with the particular feature that their shape is larger to allow demolding long the x-y projection of the deflecting ribs 7.3. It is important in any case that the openings 7.3 not be too big so that the smallest possible conductor can be slid through them or the abutment 7.5 would become ineffective. If one is certain that the x-y projection of the deflecting ribs 7.2 and 7.3 and the deflecting flank 7.4 of the abutment 7.6 do not overlap, the wire seats 7.1 or the entire wire holder can be deformed in a very simple manner along the longitudinal axis z. Further features of the wire holder are the coding or twist preventer 7.9, the guide face 7.16, and the abutment face 7.15 that are important with regard to the contact holder 2. The groove 7.11 serves for holding or guiding the contact element 13. The groove-like recess 7.11 also forms a coding or twist preventer for the sleeve 9. The surfaces 7.12 are grip surfaces by means of which the wire holder 7 can be pulled out of the contact holder 2. The wire holder 2 is engaged on the faces 7.13 indirectly via the sleeve 9 and the coupling element 6 with the contact holder carrying the press-fit clips. The test bore 7.14 that extends conically over a portion of its length allows the user to determine if the diameter of the wire to be fitted will go into the wire seat 7.1 of the wire holder 7. The conical (or alternately flat) surface 7.17 has the function of fixing the contact element 8 in the z-direction such that a radial force component is created toward the plug center axis, that is toward the cable shielding.

Figure 5:
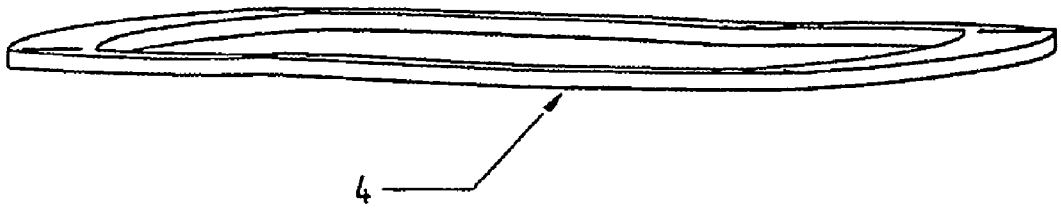
FIGS. 5 and 6 are views of contact elements.

FIG. 5 shows the contact element 4 necessary for a continuous shielding between the coupling element 3 and the coupling element 6. The contact element 4 fits with the faces of the coupling elements 3 and 6 and is preferably a washer.

Figure 6:
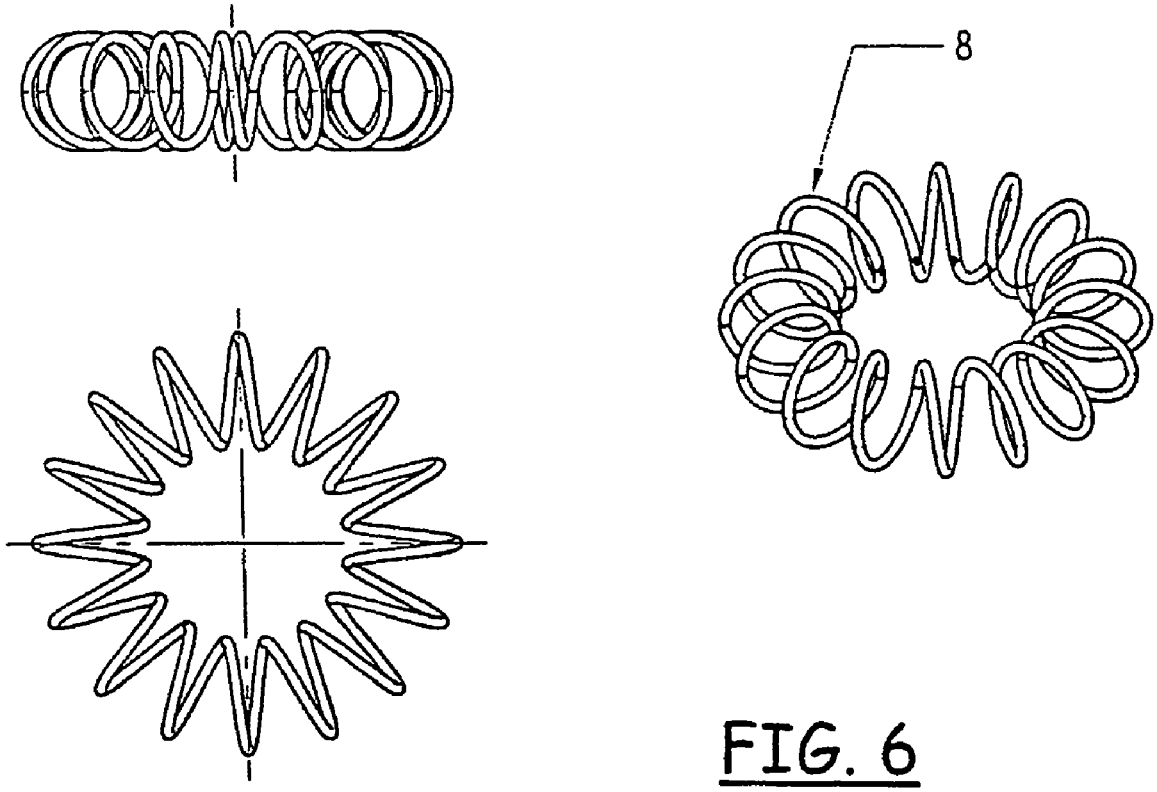

FIG. 6 shows a contact element 8 that is formed as an iris spring (a coil spring shaped permanently or not into a torus). It would also be possible to use for this purpose a similar stamped or bent wire part. In the case when the sleeve 9 is made by injection or pressure molding, such spring element can even be integrally (one-part solution) imbedded in the actual workpiece. The contact element 8 serves to electrically connect the shielding of the cable and the casing of the plug (here the sleeve 9) in order to effect throughgoing shielding. The iris spring is particular advantageous because it can be slipped without other means or special fitting over the shielding of the cable.

Figure 7:
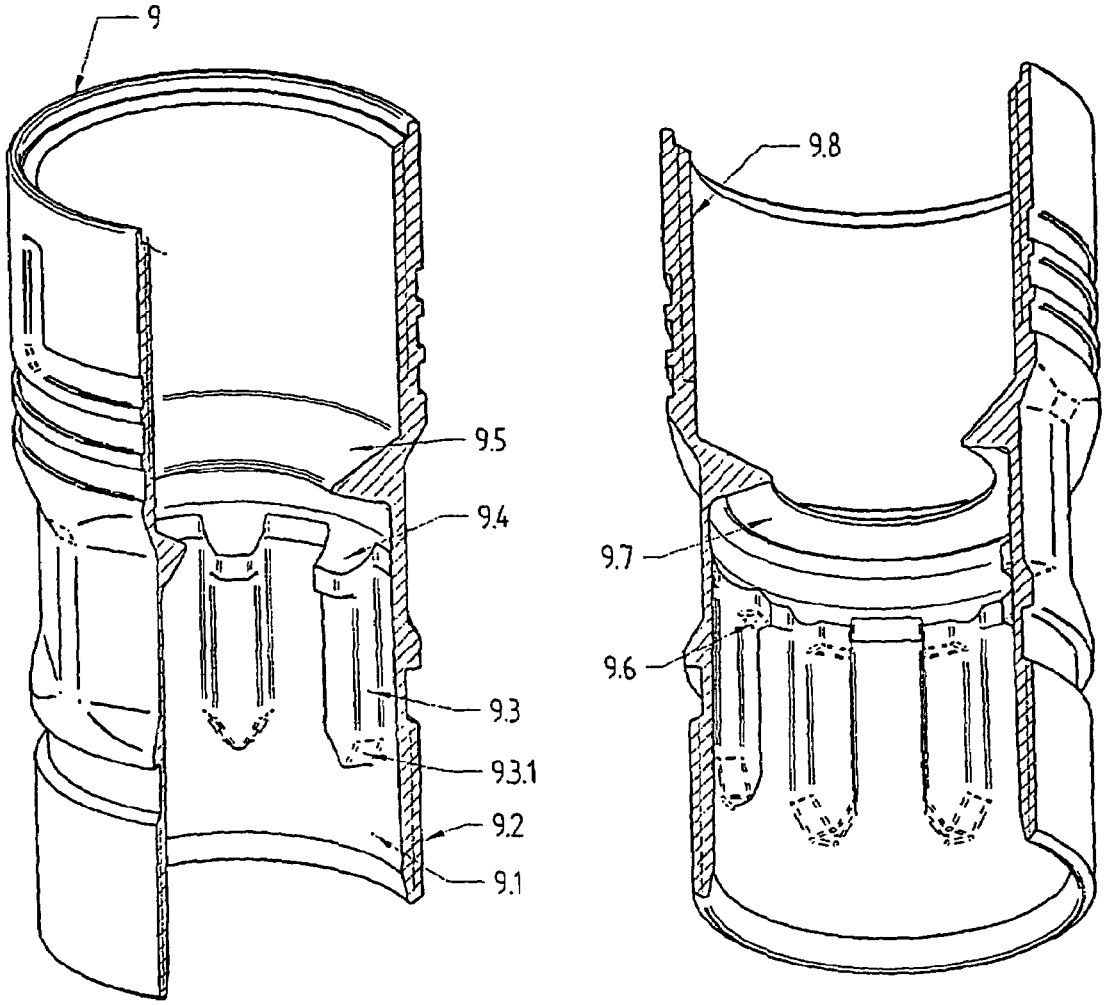
FIG. 7 shows the casing of the plug.

FIG. 7 shows a further part of the casing formed by the sleeve 9, here in particular a closed metallic or metallized sleeve with a seal face 9.1 for the seal element 5, a coupling part, for example a screwthread 9.2 for the coupling element 6, a seal face 9.5 for the seal element 10, and a coupling part, for example a screwthread 9.8 for the actuating element 12. In addition the sleeve 9 has at least one coding or twist preventer 9.3 complementary to the recesses 7.11 with guide bevels 9.3.1 and if necessary with an abutment face 9.4 for the contact element 8. Like the abutment faces 7.13 on the wire holder 7, the sleeve 9 has engagement faces 9.6. The conical (or alternatively even flat) 9 surface 9.7 has for the contact element 8 the same function as the surface 7.17 of the wire holder 7.

Figure 8:
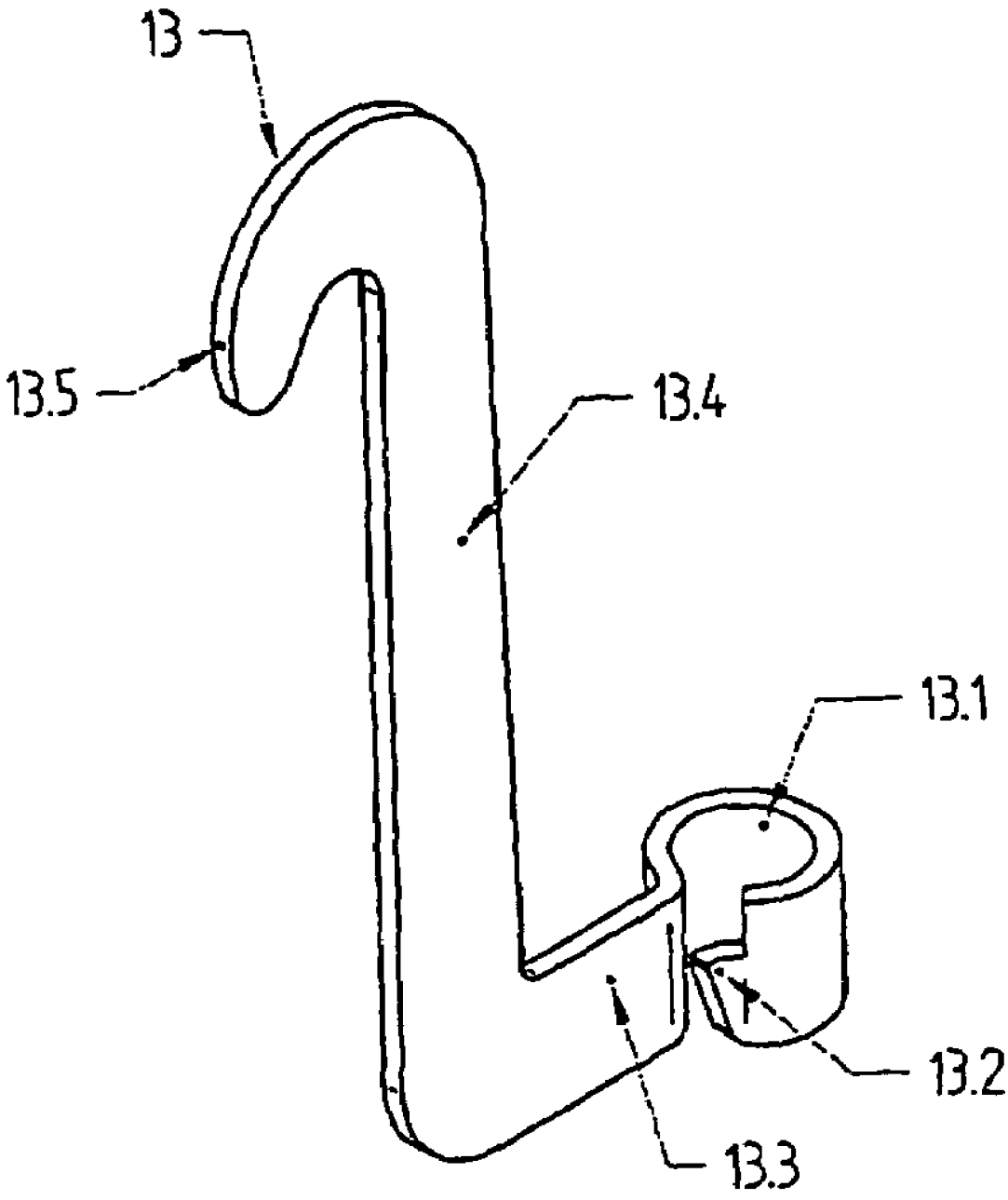
FIG. 8 is a contact for creating an electrical contact between the casing of the plug and at least one, preferably the center contact.

FIG. 8 shows the contact element 13 that for example is formed as a stamped or bent-wire piece. This contact element 13 has a mounting or contact eye 13.1 with a contact element 13.2 (or vice versa), the contact eye 13.1 bearing elastically on the center contact 1 and forming an electrical contact therewith. In addition there is a mounting leg 13.3, a spring blade 13.4 and a contacting face 13.5 by means of which the electrical connection to the metallized or metallic housing is made. It is also possible to use a contact element where the spring blade 13.4 and the contact face 13.5 are so constructed that the respective contact 1 is not connected with the casing of the plug but directly with the cable shielding 15 or with the contact element 8.

For assembly (connecting the cable according to press-fit techniques and putting together of the plug) there are the following subassemblies and individual parts:

Entire contact holder: contacts 1+contact holder 2+coupling element 3+contact element 4+connector element 6+seal element 5+contact element 13;

Wire holder;

Entire housing: sleeve 9+contact element 8; alternatively sleeve 9 and contact element 8 as individual parts;

Entire strain-relief element: seal element 10+strain-relief element 11;

Actuating element (12);

Cable with exposed shield 15 and exposed wires 16.

For assembly the following steps are necessary:

The cable jacket 14 is stripped off at one end so that the wires 16 and the cable shielding 15 are exposed over a predetermined length; then the cable shielding 15 is trimmed back.

The actuating element 12, the strain-relief element and the seal element 10 as well as the sleeve 9 with the contact element 8 are slipped over the exposed wires 16 and the shielding 15 onto the cable jacket 14.

The wires 16 are pushed into the respective wire seats 7.1 of the wire holder 7 up to the abutment faces 7.6.

The sleeve 9 with the contact element 8 is fitted with the loaded wire holder 7.0 that the surfaces 7.12 and 9.6 touch each other.

The strain-relief element 11 and the seal element 10 are secured together by means of the actuating element 12 with the sleeve 9.

The subassemblies on the cable are fitted together with the entire contact holder via the coupling element 6; during this process the press-fit clips are pushed into the respective wires 16 that are in turn secured in the respective wire seats 7.1 so that the electrical connection between a conductor and the respective contact pin 1 is made.

The contact elements 4 and 8 make the electrical connection between the shielding 14 of the cable through the conductive parts of the casing of the plug to the actuating element 3, so that when the plug is fitted with the appropriate socket or sleeve through the appropriate coupling element the shielding is continuous. Alternatively or in addition the shielding 14 of the cable is connected through the contact element 13 with one of the contacts 1. In this matter there is for example a continuous ground.

Figure 9A:
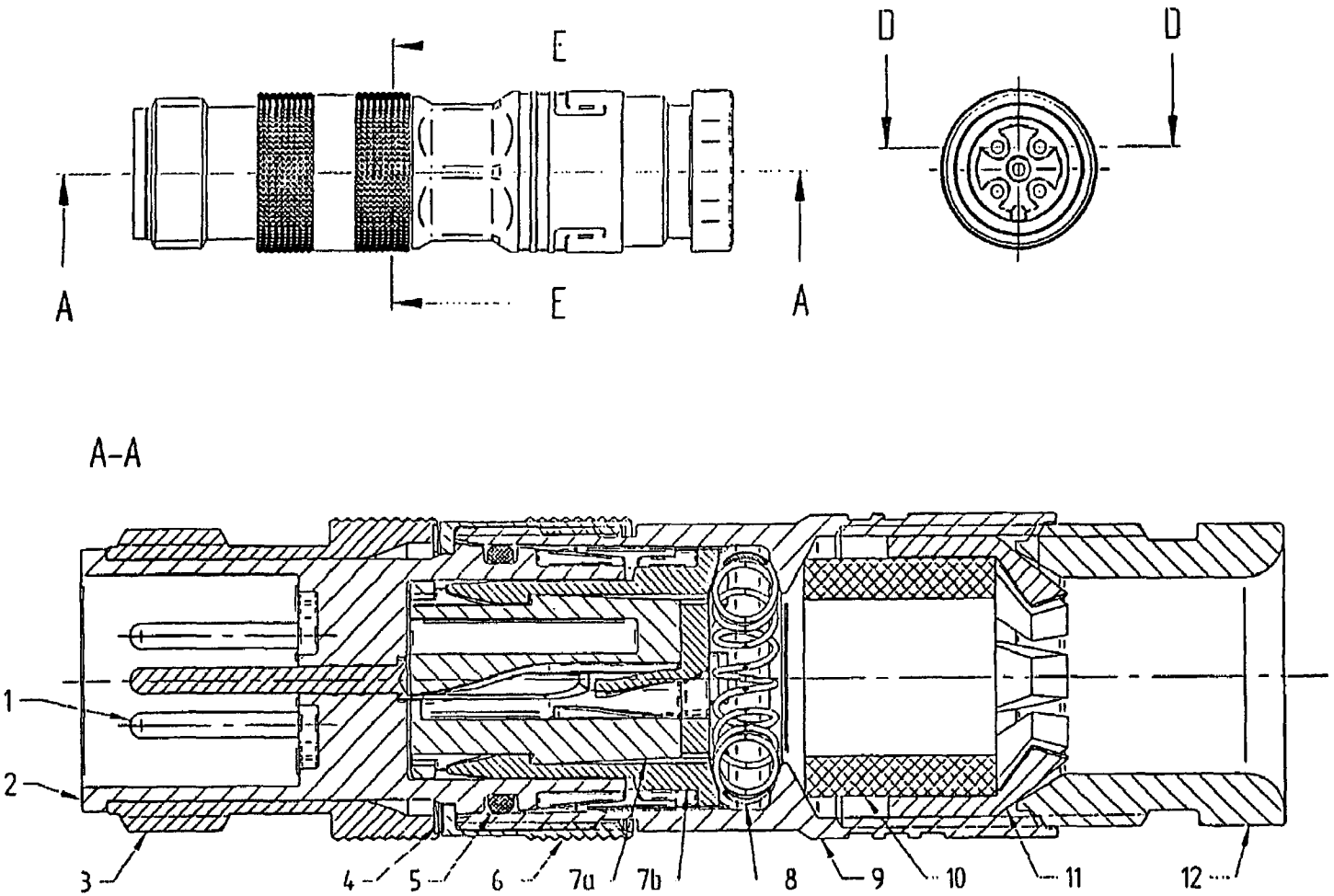
FIGS. 9 to 11 are overall, sectional, and detail views of a further embodiment of a plug.
Figure 10:
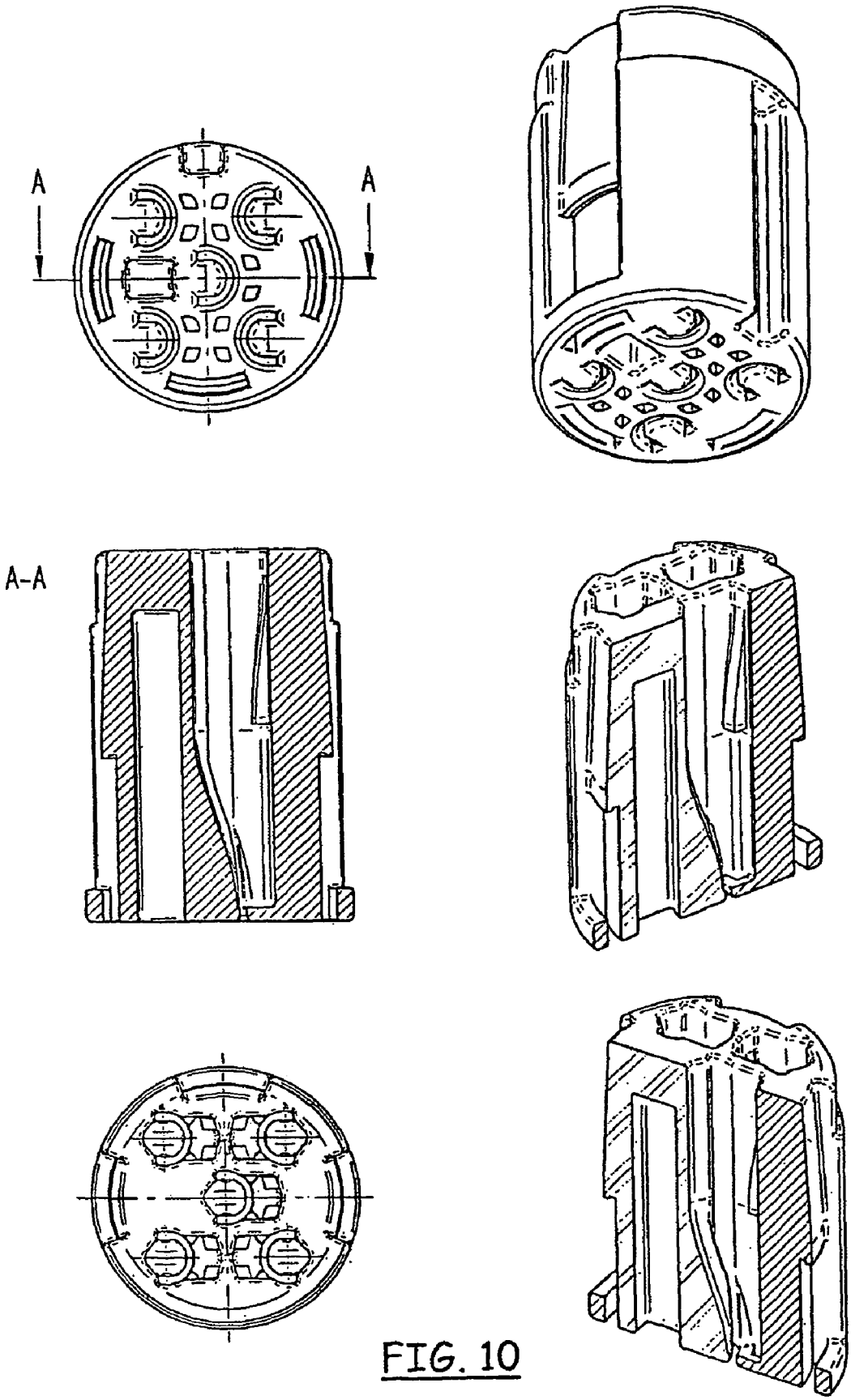
Figure 11:
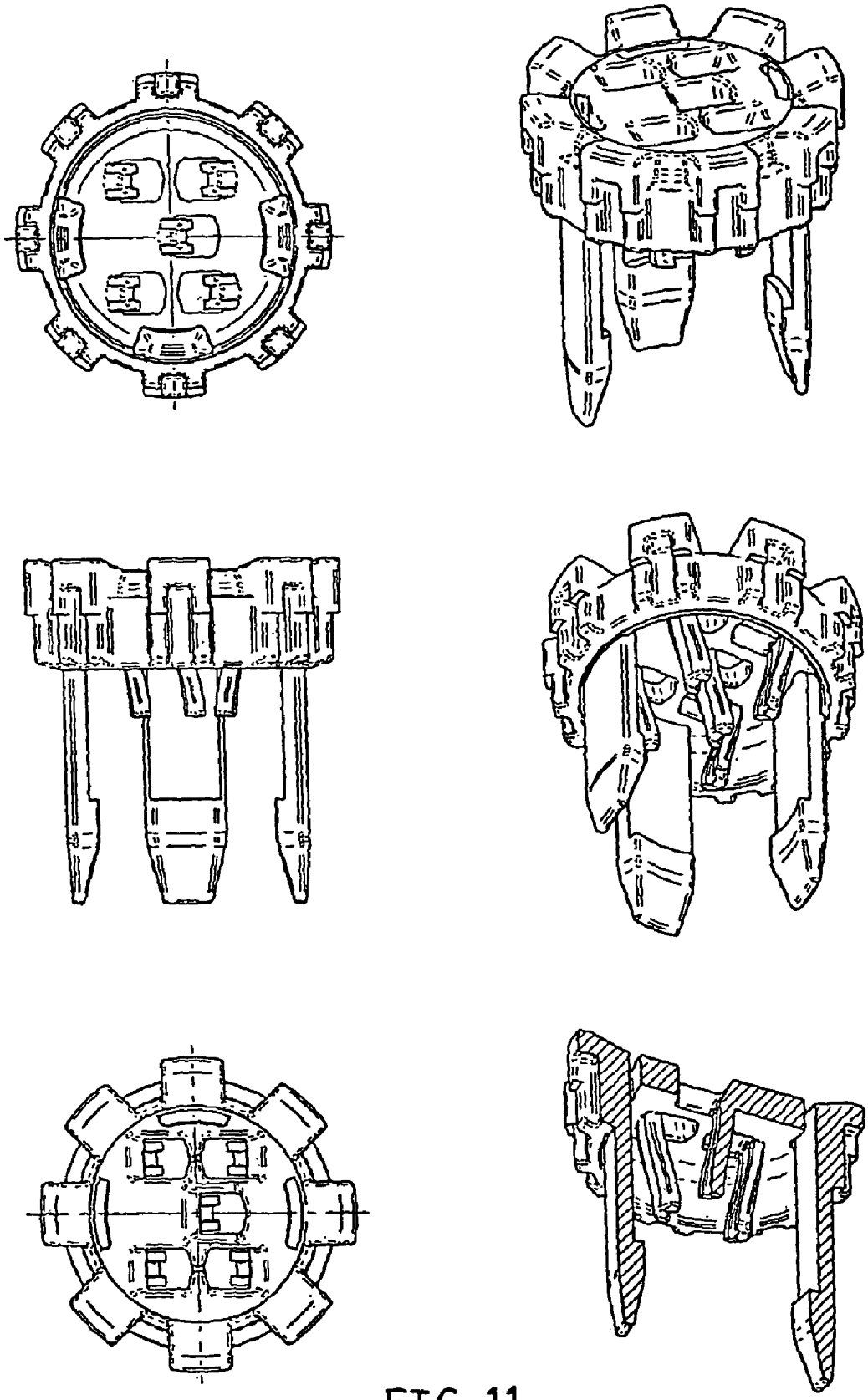

FIGS. 9*a* and 9*b* as well as 10 and 11 are overall, sectional, and detail views of a further embodiment of a plug. The plug shown in these figures is different from that of FIG. 1 in that here the wire holder 7 is formed of a wire holder 7*a* (see FIG. 190) and a retainer 7*b* (see FIG. 11). This connection can be undone (as shown in FIG. 10 by a snap fit or the like). The wire holder 7*a* has in this case in the wire seat only one fixed deflecting rib so that the function of the second rib is taken over by the blade of the retainer 7*b* projecting into this seat. This blade and the conductor thus serve not only a deflecting but also a mounting function.

The invention claimed is:

1. A plug or socket connectable to a coaxial cable having a plurality of conductors and a tubular shielding surrounding all of the conductors, the plug or socket being formed of several subassemblies and comprising:

an electrically conductive casing sleeve defining an axis and receiving the coaxial cable with the tubular shielding in electrical contact with the casing sleeve;

an electrically insulating holder fitted in the casing sleeve and having an axially throughgoing and central passage generally at the axis and an array surrounding the axis of axially throughgoing outer passages that lie between the central passage and the casing sleeve;

respective contacts in the central and outer passages, the contacts in the outer passages each having a press-fit connection secured to a respective one of the conductors; and a conductive contacting element separate from but in electrical contact with the casing sleeve and with the contact in the central passage, the contacting element forming an electrical connection between the central contact and the shielding, the contacting element having at one end an eye gripping the contact in the center passage and an outer end electrically connected to the casing sleeve.

2. The plug or socket as defined in claim 1 wherein the shielding of the coaxial cable is a shield braid and the contacting element is formed in part as an iris spring.

3. The plug or socket as defined in claim 1 wherein the press-fit connections each have a pair of press-fit arms that contact the respective conductor generally axially.

4. The plug or socket as defined in claim 3 wherein the press-fit arms are fixable at least partially in a wire holder of a part of one of the subassemblies.

5. The plug or socket as defined in claim 4 wherein each pair of arms forms a conductor seat that tapers on one side at a deflecting surface to a cross section and an end of the respective conductor is poked between the respective press-fit arms.

6. The plug or socket as defined in claim 3 wherein the press-fit arms extend generally axially of the socket or plug.

7. The plug or socket as defined in claim 1 wherein the wire holder has respective conductor seats aligned with the outer passages and each holding the respective contact.

8. The plug or socket as defined in claim 1 wherein the contacting element is flat and lies generally in a plane including the axis and passing between two of the outer passages.

9. The plug or socket as defined in claim 1 wherein each of the contacts has a front pin end projecting axially from the holder.

10. The plug or socket as defined in claim 9 wherein the contacts in the outer passages each have a rear forked end gripping the respective conductor.

* * * * *